US006039178A

United States Patent [19]

Ernst

[11] Patent Number: 6,039,178

[45] Date of Patent: Mar. 21, 2000

[54] ORGANIZER FOR A SET OF HAND TOOLS

[76] Inventor: Gregory R. Ernst, 15735 SE. Bartell Rd., Boring, Oreg. 97009

[21] Appl. No.: 09/264,554

[22] Filed: Mar. 8, 1999

[51] Int. Cl.[7] ..... B65D 85/00

[52] U.S. Cl. ..... 206/376; 211/70.6

[58] Field of Search ..... 206/372, 373, 206/376, 443, 564; 211/70.6

[56] References Cited

U.S. PATENT DOCUMENTS

| | | | |
|---|---|---|---|
| 3,077,977 | 2/1963 | Wood | 211/70.6 |
| 3,702,136 | 11/1972 | Albertson | 206/376 |
| 3,837,477 | 9/1974 | Boudreau | 206/376 |
| 4,705,168 | 11/1987 | Ward | 206/376 |
| 5,346,063 | 9/1994 | Chow | 206/376 |
| 5,505,316 | 4/1996 | Lee | 206/376 |
| 5,598,924 | 2/1997 | McCann | 206/372 |

*Primary Examiner*—Jim Foster
*Attorney, Agent, or Firm*—James D. Givnan, Jr.

[57] ABSTRACT

A holder for elongate hand tools includes sets of notched rail members disposed in convergent fashion on a supporting surface such as the bottom wall of a tool chest drawer. Each set includes a rail member mounted in parallel with a sidewall of the drawer or other supporting surface while another rail member is inclined to the first mentioned rail member and sidewall of the drawer. Similarly disposed rail members of the second set effect efficient utilization of drawer space.

6 Claims, 2 Drawing Sheets

ORGANIZER FOR A SET OF HAND TOOLS

BACKGROUND OF THE INVENTION

The present invention pertains generally to the orderly storage of hand tools in a holder.

Various racks are utilized for the orderly storage of sets of hand tools usually with the hand tools in place on a rack according to their different lengths. Such racks, otherwise termed organizers, may utilize a cooperating pair of upright rails each having recesses which align with those on the remaining rail member to receive a laterally inserted hand tool. A web of material may join the two rail members and may be provided with a hand grip for tool transport. One such rack is disclosed in U.S. Pat. No. Design 392,489, issued to the present inventor. Other racks or organizers may utilize parallel or convergent rail members each having a series of recesses or grooves for tool reception. A rail member may be provided with a series of large recesses, as for example, to hold the handle of a screwdriver, while the remaining rail has a series of lesser sized recesses to receive the screwdriver shank. The latter type rack is the subject of a co-pending design application filed by the present inventor and under a pending status.

The foregoing mentioned racks or organizers serve a purpose of providing orderly storage of hand tools according to their graduated length. A problem arises when such racks or organizers are used within a confined area such as in the drawer of a tool chest or cabinet. The surface area of the drawer bottom is not fully utilized as that end of the rack receiving small hand tools will be offset horizontally from a drawer sidewall leaving a generally triangularly shaped area void or wasted space. A further problem associated with the storage of a series of graduated wrenches or other tools is that each tool handle is not visible to display wrench indicia.

SUMMARY OF THE PRESENT INVENTION

The present invention concerns the provision of a first set of rail-like tool holders for installation in a tool box drawer with one rail member of the set in parallel with an adjacent sidewall of the drawer. A second set of tool holders also includes a rail member offset from and in parallel with a drawer sidewall. A remaining rail member of each set is out of parallel with the drawer sidewalls. Accordingly, when installed in a tool box or chest drawer, the tool holder or organizer fully occupies a rectangular area of the drawer bottom with no lost or unutilized space. Further, rail member configuration provides for rearwardly tilting of the hand tools, in the case of wrenches, to display indicia on the tool handle and facilitate removal from the rack. For optimum utilization of drawer space the rail members of each set are of dissimilar lengths with an inclined rail member of each set extending in a diagonal manner relative the front and rear walls of the drawer. The rail sets converge in opposite directions with the oppositely disposed convergent ends of the rail sets being disposed respectively adjacent the front wall and rear wall of a drawer. For example, the convergent end segments of one rail set receive the smallest hand tool of a wrench set while the divergent ends of the remaining rail set will receive the largest hand tool of a tool set to best utilize the surface area of a tool drawer. The rail-like holders of each set will preferably extend the distance between front and rear walls of a tool chest drawer.

Important objectives of the present invention include the provision of multiple sets of tool holding rail-like members which, when occupied with tools, occupies a drawer area with a minimum of lost space; the provision of tool storage members provided in sets with one rail member of each set intended for installation on a drawer bottom in parallel with a drawer sidewall with the remaining rail member of each set extending in diagonal fashion intermediate the front and rear walls of a tool chest drawer; the provision of sets of tool storage rails which receive hand tools of graduated lengths to store tools in a rearwardly inclined manner with the smaller tools supported in a raised manner for purposes of identification.

DETAILED DESCRIPTION OF THE PREFERRED EMBODIMENTTS

Figures 1, 6:
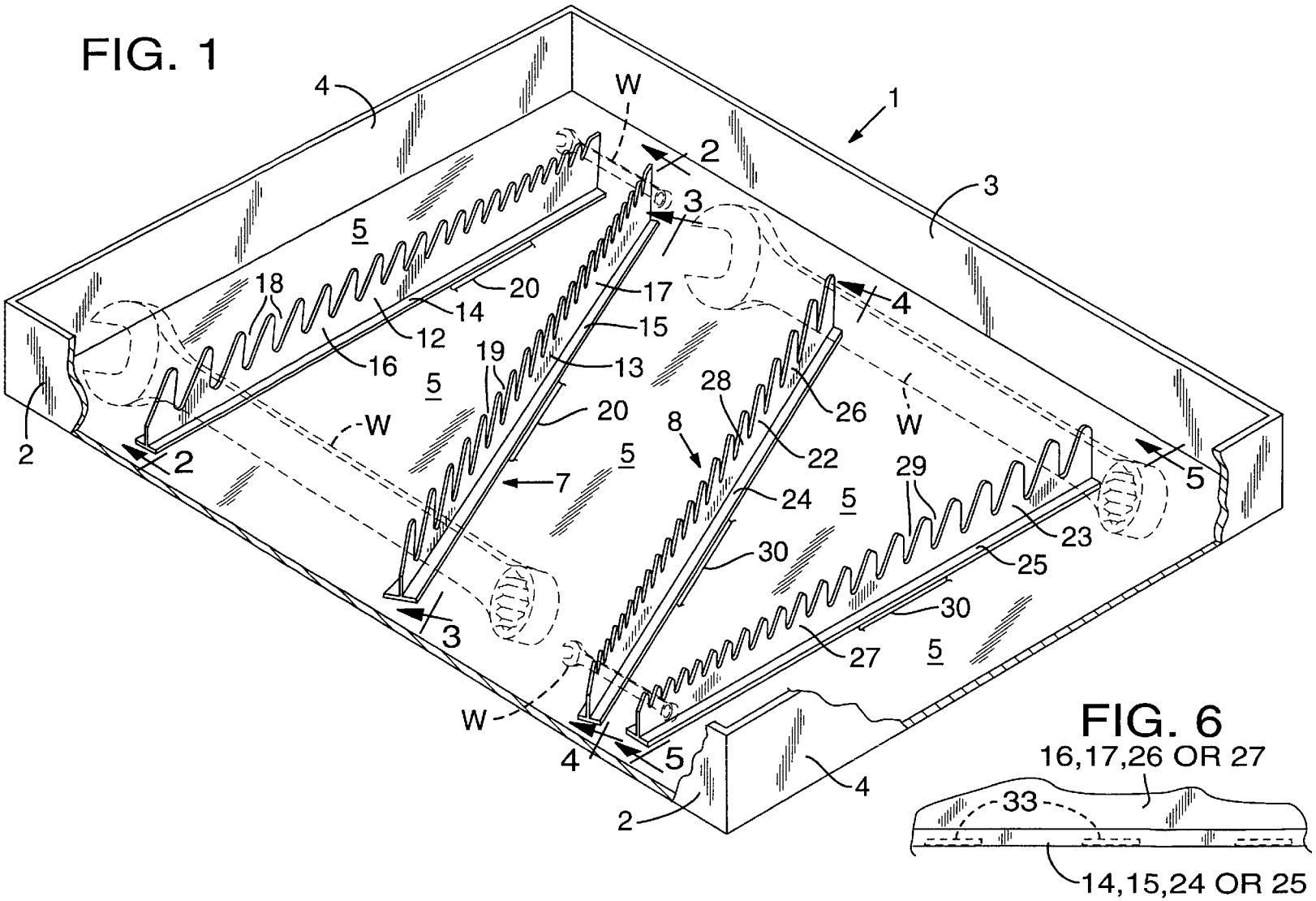
FIG. 1 is a perspective view of a tool chest or cabinet drawer with the present invention in place therein.
FIG. 6 is a fragmentary side elevational view of a rail member with magnetic mounting means.
Figure 2:
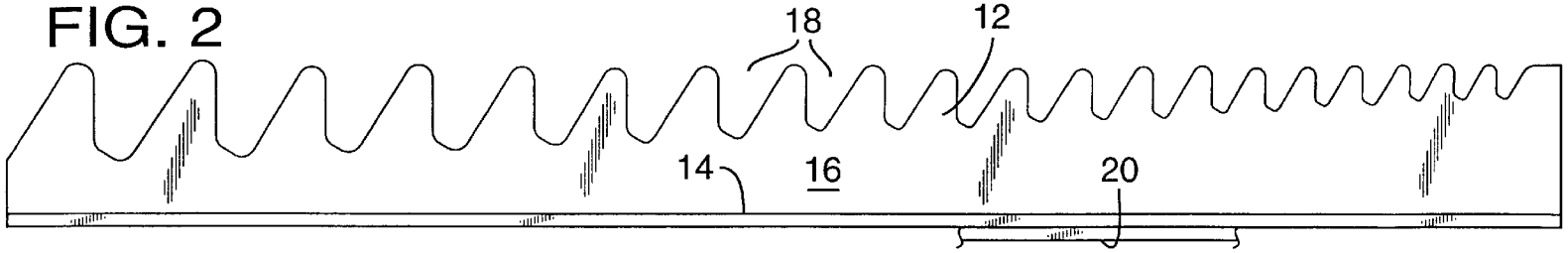
FIGS. 2 through 5 are side elevational views taken along lines 2–5 of FIG. 1.

With continuing attention to the drawings wherein applied reference numerals indicate parts similarly hereinafter identified, the reference numeral 1 indicates generally a drawer removed from a tool chest or tool box and having a front wall 2, rear wall 3 and side walls 4. A bottom wall is at 5. While bottom wall 5 is shown to be part of a tool box drawer it may represent any horizontal rectangular support surface area serving to receive the following described rail sets.

With further reference to FIG. 1, a first set of tool supporting rail members is indicated generally at 7 adjacent sidewall 4 while a second set of toll supporting rail members are indicated generally at 8 adjacent opposite sidewall 5. With regard now to said first set of rails, rail members are indicated at 12 and 13 each having a base 14 and 15 retained in place on drawer surface 5 as by mounting means such as a double sided adhesive strip at 20. Both rail members 12–13 are of inverted T-shape in cross section. In continuing similarly between rail members 12 and 13, each includes an upright rib at 16–17 which defines tool receiving mutually aligned recesses at 18–19 which are shown as of progressively lesser depth and width in the front-to-rear direction of surface 5. Accordingly a hand tool such as a wrench at W is supported by aligned recesses 18–19 in rail members 12-13 with convergence of the rail members as they extend toward the rear extremity of surface 5.

The smaller wrenches W of a set are elevated with respect to the immediately preceding wrench supported by the rail set to assure markings on the wrench handle being visible to the user. It will be noted that the left hand rail member 12, as viewed in FIG. 1, is in parallel with the side extremity of surface 5, shown as a drawer sidewall 4.

Now with attention again to the second rail set indicated generally at 8, rail members at 22 and 23 each include a base 24–25, preferably held in place in surface 5 by mounting means shown as, for example, an adhesive double sided strip 30. Each rail member 22 and 23 is of inverted T-shape section with the rib portion 26–27 thereof defining a series of recesses 28–29 with the recesses gradually and successively diminishing in depth and width in a rear-to-front direction of surface 5. Accordingly smaller sized wrences W are located proximate convergent end segments of rail members 22 and 23 in an elevated or raised position when compared with larger sized wrenches W stored in recesses 28-29 on the rearward or divergent end segments of rail members 22–23.

It will also be seen that wrenches placed in aligned recesses 18–19 of the convergent end segments of the first set of rail members 12–13 will be highly visible to a user located in front of drawer 1 as the handles of smaller wrenches have their handles elevated relative the handles of larger wrenches in members 12–13 of recesses 18–19 are elevated in a gradual, successive manner in the direction of rail member convergence.

Figure 3:
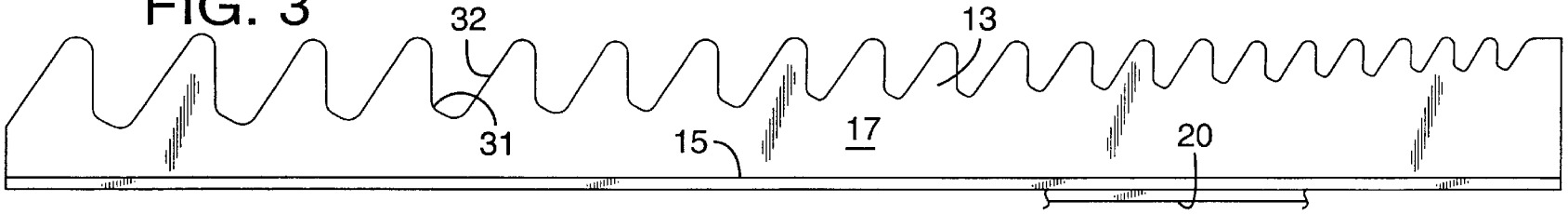
Figure 4:
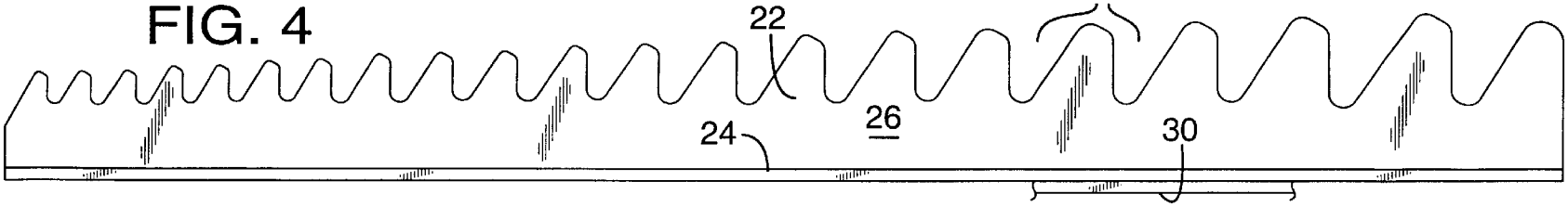
Figure 5:
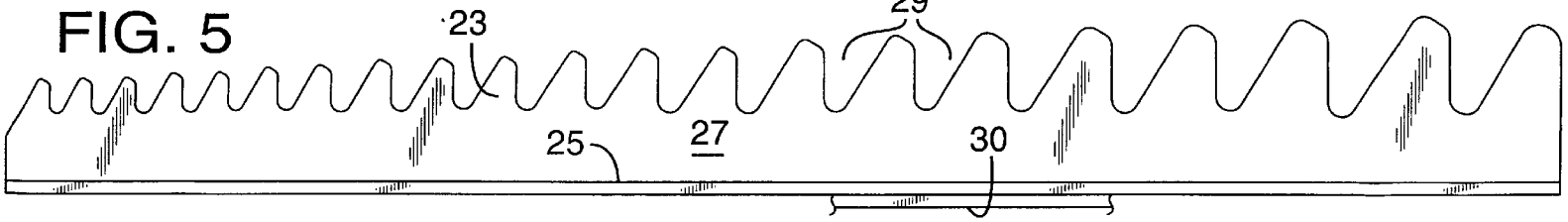

The bottom edge and rearwardly sloped rearward edge, typically shown at 31 and 32 in FIG. 3, of each tool receiving recess in the rail members support the tool therein in the manner best displaying imprinted indices on the tool handle.

As one rail member of each rail set 7 and 8 is inclined with respect to a sidewall 4 of surface 5, it may be termed an inclined rail member while its companion rail member, as earlier noted, is in substantially parallel relationship with sidewall 4 of surface 5. The inclined rail members 13 and 22 are of somewhat greater length than their companion rail members 12 and 23. Accordingly the rail member recesses 18 will be somewhat more closely spaced than the recess 19 of rail member 13. The same applies to the recesses 28–29 of rail members 22–23. The elongate hand tools supported in the aligned recesses of the rail members of the rail sets will be positioned in parallel with one another and with the front and rear extremities of surface 5. The mounting means noted above may be otherwise embodied in magnetic members 33 secured in place on the base 14–15 and 24–25 of each rail member 12–13 and 22–23.

While I have shown but one embodiment of the invention, it will be apparent to those skilled in the art that the invention may be embodied still otherwise without departing fromt he spirit and scope of the invention.

Having thus described the invention, what is desired to be secured by a Letters Patent is:

1. In combination, a support surface having front and rear walls and a first sidewall and a second sidewall parallel to said first sidewall, a first set of rail members extending intermediate the front and rear walls of the support surface and adjacent said first sidewall, each of said rail members of the first set having a series of recesses aligned in pairs for reception of an elongate tool, inclined edges on each of said members partially defining said recesses, one of said members in parallel with said first sidewall, another of said members out of parallel with said first sidewall, a second set of rail members extending intermediate the front and rear walls of the support surface and adjacent said second sidewall and each of said rail members of the second set located between said first set of rail members and said second sidewall and having a series of recesses aligned in pairs for reception of an elongate tool, inclined edges on each of said second set of members partially defining said recesses, one of said members of the second set in parallel with said second sidewall, another of said members of the second set out of parallel with said second sidewall, said first set of rail members having convergent end segments and divergent end segments disposed respectively adjacent the rear and front walls of said support surface, said second set of rail members having convergent end segments and divergent end segments disposed respectively adjacent the front and rear walls of said support surface.

2. The combination claimed in claim 1 wherein the depth of said recesses in the first set and the second set of rail members diminishes in the direction of rail member convergence and the elevation of said recesses increasing in a successive manner in the direction of rail member convergence.

3. The combination claimed in claim 1 wherein the rail members of said first set are of unequal length and the rail members of said second set are also of unequal length.

4. In combination, a support surface having front, rear and first and second sidewalls, first and second sets of elongate tool holders in place on said support surface and located respectively adjacent said first and second sidewalls with said second set of elongate tool holders being located between the first set and the second sidewall of the support surface, one tool holder of each of said sets in parallel with the sidewalls of said support surface, a second tool holder of each of said sets out of parallel relationship with the sidewalls of said support surface, and said second tool holder of each of said sets greater in length than said one tool holder of each of said sets.

5. The combination claimed in claim 4 wherein each of said tool holders includes a base and an upstanding rib on said base defining a series of upwardly open recesses.

6. The combination claimed in claim 5 wherein said recesses of each tool holder vary in depth and in elevation from said support surface in a successive and inverse manner.

* * * * *